US009148944B2

(12) United States Patent
Tang et al.

(10) Patent No.: US 9,148,944 B2
(45) Date of Patent: Sep. 29, 2015

(54) ELECTRON LINEAR ACCELERATOR SYSTEMS

(71) Applicants: Nuctech Company Limited, Haidian District, Beijing (CN); Tsinghua University, Haidian District, Beijing (CN)

(72) Inventors: Chuanxiang Tang, Beijing (CN); Jiaru Shi, Beijing (CN); Qingxiu Jin, Beijing (CN); Huaibi Chen, Beijing (CN); Wenhui Huang, Beijing (CN)

(73) Assignees: Nuctech Company Limited, Haidian District, Beijing (CN); Tsinghua University, Haidian District, Beijing (CN)

( * ) Notice: Subject to any disclaimer, the term of this patent is extended or adjusted under 35 U.S.C. 154(b) by 0 days.

(21) Appl. No.: 14/487,891

(22) Filed: Sep. 16, 2014

(65) Prior Publication Data

US 2015/0084550 A1 Mar. 26, 2015

(30) Foreign Application Priority Data

Sep. 22, 2013 (CN) ..... 2013 1 0432067

(51) Int. Cl.

| | |
|---|---|
| ***H05H 7/02*** | (2006.01) |
| ***H05H 7/22*** | (2006.01) |
| ***H05H 7/18*** | (2006.01) |
| ***H05H 9/00*** | (2006.01) |
| ***H05H 9/04*** | (2006.01) |

(52) U.S. Cl.

CPC . *H05H 7/22* (2013.01); *H05H 7/02* (2013.01); *H05H 7/18* (2013.01); *H05H 9/00* (2013.01); *H05H 9/048* (2013.01); *H05H 2007/027* (2013.01); *H05H 2007/227* (2013.01)

(58) Field of Classification Search

CPC ..... H05H 7/22; H05H 9/00; H05H 9/02; H05H 2007/027

USPC ..... 315/505, 501, 500, 506

See application file for complete search history.

(56) References Cited

U.S. PATENT DOCUMENTS

| | | | | |
|---|---|---|---|---|
| 2,813,996 | A * | 11/1957 | Chodorow | 315/5.42 |
| 8,330,397 | B2 * | 12/2012 | Meddaugh | 315/505 |
| 2010/0039051 | A1 | 2/2010 | Clayton et al. | |

* cited by examiner

*Primary Examiner* — Tuyet Vo

(74) *Attorney, Agent, or Firm* — Merchant & Gould P.C.

(57) ABSTRACT

The present disclosure discloses an electron linear accelerator system. In the present disclosure, a fast-switching dual-path microwave system is proposed, wherein, one path can be directly connected to an accelerating tube, and the other path can be input into the accelerating tube after a magnitude of the microwave power is changed by devices such as an attenuator, a power divider, a pulse compressor or even an amplifier etc., so as to achieve fast switch of the power input into the accelerator and adjust the energy output by the accelerator.

9 Claims, 1 Drawing Sheet

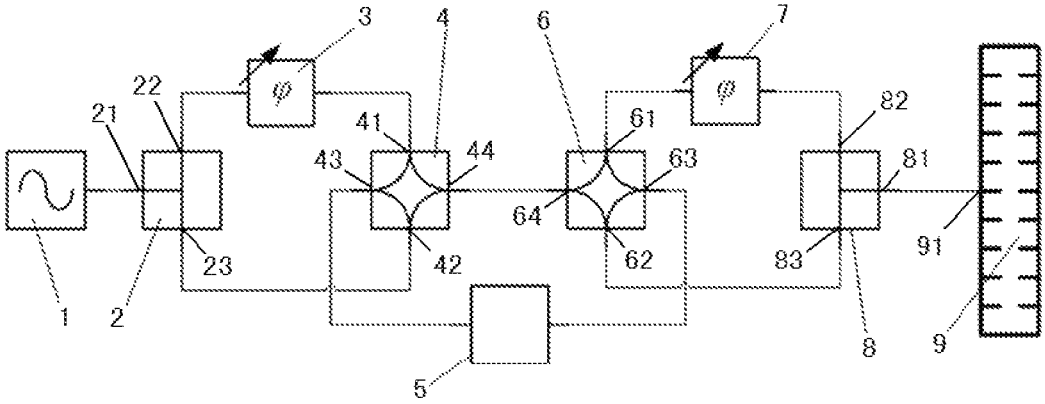
3
4
6
7
22
21
41
61
82
43
44
63
81
64
91
23
42
62
83
1
2
8
9
5

ELECTRON LINEAR ACCELERATOR SYSTEMS

This application claims benefit of Serial No. 201310432067.8, filed 22 Sep. 2013 in China and which application is incorporated herein by reference. To the extent appropriate, a claim of priority is made to the above disclosed application.

TECHNICAL FIELD

The present disclosure relate to the field of accelerators, and more particularly, to the field of medical and industrial accelerators.

BACKGROUND

The technology of the dual-energy electron linear accelerator is widely applied in imaging inspection systems such as containers/vehicles inspection systems etc. Substances can be distinguished using the difference between the attenuation characteristics of both high energy X-ray and low energy X-ray passing through materials with different atomic coefficients. A dual-energy X-ray inspection system requires emitting a beam at two energy levels. As a repetition frequency is typically on the order of 100 Hz, the energy is required to be switched on the order of milliseconds. The electron linear accelerator is typically comprised of sub-systems such as a microwave power source, a microwave transmission system, an electron gun, an accelerating tube etc. The existing methods for adjusting the energy of the accelerator primarily comprise: changing the energy by 1) changing a magnitude of microwave power input into the accelerator; 2) changing a magnitude of a beam load of the accelerator; and 3) changing a distribution of a part of electromagnetic field in the accelerator by designing an accelerating structure in a particular manner.

In the method 1), the manner of directly changing the magnitude of the energy of the power source input into the accelerator is easy and feasible. However, when power output from the microwave power source is switched rapidly, a condition that the frequency changes and the output power is unstable may occur for the microwave power source.

In the method 2), the beam load of the accelerator is regulated by changing a current emitted by the electron gun, and the energy of the electron beam is reduced by absorbing more microwave power by a stronger beam. However, as a dosage rate is directly related to the magnitude of the beam, the regulation of the parameter is less flexible; and at the same time, the demands on the electron gun also increase.

In the method 3), the accelerating structure is usually very complex, and it generally needs to regulate the hardware structure of the accelerating tube so as to regulate the field distribution of the accelerator, which has a slow time response.

Further improvements may be made to the method for adjusting an energy based on the method 1). The improved method changes the microwave power input into the accelerating tube while the microwave power source operating in the same state, so as to ensure that the frequencies of the microwave source at the two energy levels are consistent and the output power is stable. This solution needs to add a microwave transmission system which can switch the attenuation or gain rapidly between the accelerating tube and the microwave source.

US patent US20100039051 discloses a method based on a magic-T element. An arm in the magic-T is connected to a phase shifter. The power input into the accelerating tube is regulated by changing a reflection phase of the arm rapidly to change a division ratio between power input into two output ports during power synthesis with another arm. However, the method operates in a total-reflective pure standing wave state, the power capacity is limited, and the demands on the circulator are very high. In addition, only an output less than the power of the power source can be achieved with this method.

SUMMARY

It is an object of the present disclosure is to achieve an electron linear accelerator system which can provide outputs at more than two energy levels, and the different output energy of the electron beam can be switched rapidly.

In an aspect of the present disclosure, an electron linear accelerator system is provided, comprising: a first power divider comprising a first port, a second port and a third port, wherein, microwave is fed into the first port, and a first microwave beam and a second microwave beam with the same amplitude and phase are output from the second port and the third port; a first power combiner comprising symmetrical first port and second port and symmetrical third port and fourth port, wherein, the second port of the first power combiner is coupled to the third port of the first power divider; a second power combiner comprising symmetrical first port and second port and symmetrical third port and fourth port, wherein, the fourth port of the second power combiner is coupled to the fourth port of the first power combiner; a second power divider comprising a first port, a second port and a third port, wherein, the third port of the second power divider is coupled to the second port of the second power combiner, and microwave is input into the second port and the third port of the second power divider and output from the first port of the second power divider; and an accelerating tube comprising an electron beam input port for receiving an electron beam and a microwave feed-in port coupled to the first port of the second power divider, wherein, the electron beam is accelerated by microwave input into the microwave feed-in port; wherein, the electron linear accelerator system further comprises: a first phase shifter, provided between the second port of the first power divider and the first port of the first power combiner; a second phase shifter, provided between the first port of the second power combiner and the second port of the second power divider; and a power regulator, provided between the third port of the first power combiner and the third port of the second power combiner; wherein, the first phase shifter and the second phase shifter change a phase-shift amount synchronously, and switch between a phase-shift amount of 0 degree and a phase-shift amount of 180 degree at a predetermined frequency; and in a case that the phase-shift amount is 0 degree, the electron linear accelerator system operates in a first state, and in a case that the phase-shift amount is 180 degree, the electron linear accelerator system operates in a second state.

According to some embodiments, the power regulator is a pulse compressor for reducing a length of the microwave pulse and increasing peak power or an amplifier for increasing the power of the microwave pulse.

According to some embodiments, the power regulator is an attenuator or a power divider for reducing the power of the microwave pulse.

According to some embodiments, in the first state, the microwave is output from the third port of the first power combiner, is subjected to power regulation by the power regulator, and then is input into the third port of the second power combiner; two signals with the same phase are output from the first port and second port, and are input into the second port and third port of the second power divider respectively; and combined microwave is output from the first port of the second power divider.

According to some embodiments, in the second state, the microwave is output from the fourth port of the first power combiner, and input into the fourth port of the second power combiner; two signals with inverse phases are output from the first port and second port, is subjected to phase shift by the second variable phase shifter to generate two signals with the same phase, and are input into the second port and third port of the second power divider respectively; and combined microwave is output from the first port of the second power divider.

According to some embodiments, the first power divider and the second power divider are E-T elements, H-T elements or magic-T elements.

According to some embodiments, the first power combiner and the second power combiner are magic-T elements or −3 dB directional couplers.

According to some embodiments, both the first phase shifter and the second phase shifter are current-controlled phase shifters, and control current lines of the first phase shifter and the second phase shifter are connected in series.

According to some embodiments, both the first phase shifter and the second phase shifter are voltage-controlled phase shifters, and control voltage lines of the first phase shifter and the second phase shifter are connected in parallel.

According to the above solutions of the embodiments, the stability of two microwave pulses with different amplitudes input into the accelerating tube is improved while achieving fast switching, thereby improving the performance of the fast-switching dual-energy accelerator.

BRIEF DESCRIPTION OF THE DRAWINGS

The accompanying drawings below illustrate implementations of the present disclosure. Some embodiments of the present disclosure are provided by these accompanying drawings and implementations in a non-limited and non-exhaustive manner. In these drawings:

FIG. 1 illustrates a structural schematic diagram of an electron linear accelerator system in the prior art.

REFERENCES SIGNS LIST

1: Microwave power source
2: First power divider
3: First variable phase shifter
4: First power combiner
5: Power regulator
6: Second power combiner
7: Second variable phase shifter
8: Second power divider
9: Accelerating tube
21, 22, 23: Ports
41, 42, 43, 44: Ports
61, 62, 63, 64: Ports
81, 82, 83: Ports
91: Ports

DETAILED DESCRIPTION OF THE PREFERRED EMBODIMENTS

Specific embodiments of the present disclosure will be described below in detail. It should be noted that the embodiments described herein are illustrated merely by way of example instead of limiting the present disclosure. In the following description, numerous specific details are set forth in order to provide a thorough understanding of the present disclosure. However, it is obvious to those skilled in the art that the present disclosure may be practiced without these specific details. In other instances, well known circuits, materials or methods have not been described in detail to avoid obscuring the present disclosure.

Reference throughout this specification to "one embodiment", "an embodiment", "one example" or "an example" means that a particular feature, structure, or characteristic described in connection with the embodiment or example is included in at least one embodiment of the present disclosure. Thus, the appearances of the phrase "in one embodiment", "in an embodiment", "one example" or "an example" in various places throughout this specification are not necessarily all referring to the same embodiment or example. Furthermore, the particular features, structures, or characteristics may be combined in any suitable combination and/or sub-combination in one or more embodiments or examples. In addition, those skilled in the art should understand that a term "and/or" used herein comprises any or all combinations of one or more listed related items.

According to the embodiments of the present disclosure, a dual-path microwave system which can switch rapidly is used. In the dual-path microwave system, one path can be directly connected to an accelerating tube, and the other path can be input into the accelerating tube after a magnitude of the microwave power is changed by power regulation devices such as an attenuator, a power divider, a pulse compressor or even an amplifier etc., so as to achieve fast switch of the power input into the accelerator and adjust the energy output by the accelerator. Thus, an electron linear accelerator apparatus which outputs at more than two energy levels can be provided, and the different output energy of the electron beam can be switched rapidly on the order of milliseconds.

In some embodiments, the output of the microwave power in two paths is switched by using variable phase shifters which can be regulated quickly and combiners. Then the microwave power in the two paths is changed differently. For example, in one path, the power is changed by devices such as a pulse compressor, an attenuator, a power divider etc., and in the other path, the power is output directly. The microwave in the two paths is switched by symmetrical phase shifters and combiners, and is input into the accelerating tube. The two phase shifters change the phase shift synchronously, and may use one control system. In some embodiments, both the above phase shifters are voltage-controlled phase shifters or current-controlled phase shifters. With respect to the current-controlled phase shifters, the control currents of the two phase shifters may be controlled to be the same. For example, control current lines of the phase shifters are connected in series, to ensure that the phase changes of the both are consistent. With respect to the voltage-controlled phase shifters, the control voltages of the two phase shifters may be controlled to be the same. For example, control voltage lines of the phase shifters are connected in parallel, to ensure that the phase changes are consistent.

In some embodiments, electronic-controlled phase shifters are used, which can implement phase change on the order of milliseconds, thereby achieving switch of microwave output on the order of milliseconds.

FIG. 1 illustrates a structural schematic diagram of an electron linear accelerator system in the prior art. As shown in FIG. 1, the electron linear accelerator system includes a first power divider 2, a first variable phase shifter 3, a first power combiner 4, a power regulator 5, a second power combiner 6, a second variable phase shifter 7, and a second power divider 8. The system receives microwave from a microwave power source 1, switches between two modes, and inputs microwave in different modes to a accelerating tube 9 to accelerate an electron beam received by an electron beam input port of the accelerating tube 9, thereby implementing output of an accelerated electron beam at least two energy levels.

The first power divider 2 includes a first port 21, a second port 22 and a third port 23. Microwave is fed into the first port 21 by the microwave power source 1, and a first microwave beam and a second microwave beam with the same amplitude and phase are output from the second port 22 and the third port 23.

The first power combiner 4 includes symmetrical first port 41 and second port 42 and symmetrical third port 43 and fourth port 44. The second port 42 of the first power combiner 4 is coupled to the third port 23 of the first power divider 2.

The second power combiner 6 includes symmetrical first port 61 and second port 62 and symmetrical third port 63 and fourth port 64. The fourth port 64 of the second power combiner 6 is coupled to the fourth port 44 of the first power combiner 4.

The second power divider 8 includes a first port 81, a second port 82 and a third port 83. The third port 83 of the second power divider 8 is coupled to the second port 62 of the second power combiner 6. Microwave is input into the second port 82 and the third port 83 of the second power divider 8, and output from the first port 81 of the second power divider 8. The accelerating tube 9 includes an electron beam input port (not shown) for receiving an electron beam and a microwave feed-in port 91 coupled to the first port 81 of the second power divider 8. The electron beam is accelerated by the microwave input into the microwave feed-in port 91.

The electron linear accelerator system further includes a first variable phase shifter 3, a second variable phase shifter 7 and a power regulator 5. The first variable phase shifter 3 is provided between the second port 22 of the first power divider 2 and the first port 41 of the first power combiner 4. The second phase shifter 7 is provided between the first port 61 of the second power combiner 6 and the second port 82 of the second power divider 8. The power regulator 5 is provided between the third port 43 of the first power combiner 4 and the third port 63 of the second power combiner 6. The first variable phase shifter 3 and the second variable phase shifter 7 change a phase-shift amount synchronously, and switch between a phase-shift amount of 0 degree and a phase-shift amount of 180 degree at a predetermined frequency. In a case that the phase-shift amount is 0 degree, the electron linear accelerator system operates in a first state, and in a case that the phase-shift amount is 180 degree, the electron linear accelerator system operates in a second state.

In the schematic diagram of the system illustrated in FIG. 1, E-T elements may be selected as the first power divider 2 and the second power divider 8. A magic-T element may be selected as the first power combiner 4. For inputs of the ports 41 and 42, a sum of the inputs of the ports 41 and 42 is output from the port 43, and a difference between the input of the port 41 and the input of the port 42 is output from the port 44. For an input of the port 43, signals with the same amplitude and phase are output respectively from the port 41 and the port 42. For an input of the port 44, signals with the same amplitude but inverse phases are output respectively from the port 41 and the port 42. Similarly, a magic-T element may be selected as the second power combiner 6. For inputs of the ports 61 and 62, a sum of the inputs of the ports 61 and 62 is output from the port 63, and a difference between the input of the port 61 and the input of the port 62 is output from the port 64. For an input of the port 63, signals with the same amplitude and phase are output respectively from the port 61 and the port 62. For an input of the port 64, signals with the same amplitude but inverse phases are output respectively from the port 61 and the port 62.

In some embodiments, a pulse compressor is selected as the power regulator 5, to reduce a length of a microwave pulse and increase peak power. An input from the microwave power source 1 is divided into two signals with the same amplitude and phase by the E-T element.

In the first state, when the phase-shift amounts of the first variable phase shifter 3 and the second variable phase shifter 7 are 0 degree, the microwave is output from the port 43 of the first power combining unit 4, is compressed by the power regulator 5, and then is input into the port 63 of the second power combiner 6. Two signals with the same phase are output from the ports 61 and 62. As the phase-shift amount of the second variable phase shifter 7 is 0 degree, the microwave pulse is input into the accelerating tube through the second power divider 8. As the microwave is compressed by the power regulator 5, the peak power of the microwave pulse increases, and the energy output by the accelerator is at a high-energy level at this time.

In the second state, when the phase-shift amounts of the first variable phase shifter 3 and the second variable phase shifter 7 are 180 degree, the microwave is output from the port 44 of the first power combiner 4, and then is directly input into the port 64 of the second power combiner 6. Two signals with the inverse phases are output from the ports 61 and 62. As the phase-shift amount of the second variable phase shifter 7 is 180 degree, the two signals become in-phase, and the microwave pulse is input into the accelerating tube 9 through the second power divider 8. At this time, the energy output by the accelerator is at a low-energy level.

In some embodiments, H-T elements or magic-T elements may also be selected as the first power divider 2 and the second power divider 8. −3 dB directional couplers (90-degree combiners) may also be selected as the first power combiner 4 and the second power combiner 6. An attenuator may also be selected as the power regulator 5. At this time, the first state corresponds to a low-energy level, and the second state corresponds to a high-energy level.

While the present disclosure has been described with reference to several typical embodiments, it should be understood that the terms used herein are illustrative and exemplary terms instead of restrictive terms. As the present disclosure can be implemented in many forms without departing from the spirit or substance of the present disclosure, it should be understood that the above embodiments are not limited to any detail described above, and instead, should be widely explained in the spirit and scope defined by the appended claims, and thus any change and variation falling into the scope of the claims or equivalents thereof should be encompassed by the appended claims.

What is claimed is:

1. An electron linear accelerator system, comprising:

a first power divider comprising a first port, a second port and a third port, wherein, microwave is fed into the first port, and a first microwave beam and a second microwave beam with the same amplitude and phase are output from the second port and the third port;

a first power combiner comprising symmetrical first port and second port and symmetrical third port and fourth port, wherein, the second port of the first power combiner is coupled to the third port of the first power divider;

a second power combiner comprising symmetrical first port and second port and symmetrical third port and fourth port, wherein, the fourth port of the second power combiner is coupled to the fourth port of the first power combiner;

a second power divider comprising a first port, a second port and a third port, wherein, the third port of the second power divider is coupled to the second port of the second power combiner, and microwave is input into the second port and the third port of the second power divider and output from the first port of the second power divider; and an accelerating tube comprising an electron beam input port for receiving an electron beam and a microwave feed-in port coupled to the first port of the second power divider, wherein, the electron beam is accelerated by microwave input into the microwave feed-in port;

wherein the electron linear accelerator system further comprises:

a first phase shifter, provided between the second port of the first power divider and the first port of the first power combiner;

a second phase shifter, provided between the first port of the second power combiner and the second port of the second power divider; and a power regulator, provided between the third port of the first power combiner and the third port of the second power combiner;

wherein the first phase shifter and the second phase shifter change a phase-shift amount synchronously, and switch between a phase-shift amount of 0 degree and a phase-shift amount of 180 degree at a predetermined frequency; and in a case that the phase-shift amount is 0 degree, the electron linear accelerator system operates in a first state, and in a case that the phase-shift amount is 180 degree, the electron linear accelerator system operates in a second state.

2. The electron linear accelerator system according to claim 1, wherein the power regulator is a pulse compressor for reducing a length of the microwave pulse and increasing peak power or an amplifier for increasing the power of the microwave pulse.

3. The electron linear accelerator system according to claim 1, wherein the power regulator is an attenuator or a power divider for reducing the power of the microwave pulse.

4. The electron linear accelerator system according to claim 1, wherein in the first state, the microwave is output from the third port of the first power combiner, is subjected to power regulation by the power regulator, and then is input into the third port of the second power combiner; two signals with the same phase are output from the first port and second port, and are input into the second port and third port of the second power divider respectively; and combined microwave is output from the first port of the second power divider.

5. The electron linear accelerator system according to claim 1, wherein in the second state, the microwave is output from the fourth port of the first power combiner, and input into the fourth port of the second power combiner; two signals with inverse phases are output from the first port and second port, is subjected to phase shift by the second variable phase shifter to generate two signals with the same phase, and are input into the second port and third port of the second power divider respectively; and combined microwave is output from the first port of the second power divider.

6. The electron linear accelerator system according to claim 1, wherein the first power divider and the second power divider are E-T elements, H-T elements or magic-T elements.

7. The electron linear accelerator system according to claim 1, wherein the first power combiner and the second power combiner are magic-T elements or −3 dB directional couplers.

8. The electron linear accelerator system according to claim 1, wherein both the first phase shifter and the second phase shifter are current-controlled phase shifters, and control current lines of the first phase shifter and the second phase shifter are connected in series.

9. The electron linear accelerator system according to claim 1, wherein both the first phase shifter and the second phase shifter are voltage-controlled phase shifters, and control voltage lines of the first phase shifter and the second phase shifter are connected in parallel.

* * * * *